United States Patent [19]

Matsuda

[11] 4,006,699

[45] Feb. 8, 1977

[54] THREAD GUIDE MEANS FOR SEWING MACHINE

[75] Inventor: Kimikazu Matsuda, Hirakata, Japan

[73] Assignee: Maruzen Sewing Machine Co., Ltd., Moriguchi, Japan

[22] Filed: Nov. 19, 1975

[21] Appl. No.: 633,587

[30] Foreign Application Priority Data

June 13, 1975 Japan ..... 50-73395
Apr. 26, 1975 Japan ..... 50-52983

[52] U.S. Cl. ..... 112/241
[51] Int. Cl.[2] ..... D05B 49/00
[58] Field of Search ..... 112/241, 242, 243, 244, 112/245, 246

[56] References Cited

UNITED STATES PATENTS 3,310,015 3/1967 Gegauf ..... 112/245

*Primary Examiner*—George H. Krizmanich
*Attorney, Agent, or Firm*—Arnstein, Gluck, Weitzenfeld & Minow

[57] ABSTRACT

A take-up lever and thread guide for a sewing machine includes a first arm portion and an overlying second arm portion forming an open-ended slot communicating with an aperture spaced from the open end. The second arm portion includes a depending detent spaced from the aperture in the direction of the open end and is adapted to prevent a thread from moving outside of the slot during the operation of the take-up lever.

6 Claims, 17 Drawing Figures

THREAD GUIDE MEANS FOR SEWING MACHINE

BACKGROUND OF THE INVENTION

This invention relates to an improved thread guide means in a take-up lever for sewing machines which guide means is so constructed as to prevent displacement or threading-out of the sewing thread from the guide means during a sewing operation.

Conventional sewing machines embodying rotating oscillating shuttle hooks generally are provided with take-up levers having a closed thread eyelet or aperture through which the thread extending between the supply spool and the needle is guided. The provision in a take-up lever of a slotted arrangement, instead of a closed eyelet, which would make it possible to guide the thread between the supply spool and the needle eye, in a single step, without requiring inserting the thread into a closed eyelet, would be a decided advantage to an operator in the operation of the machine. However, in rapid sewing, the thread guide in the end of the take-up lever, in its path of travel, attains a high velocity and the use of a closed eyelet is required to insure against threading-out of the thread from the guide.

Attempts have been made to provide take-up levers with threading slots communicating with a thread guiding eyelet. Such construction is exemplified in U.S. Pat. No. 3,310,015 issued Mar. 21, 1967. However, it has been found that such constructions are not completely effective to prevent threading-out during high speed operation of the machine.

In accordance with the present invention I provide a thread guide in a take-up lever which affords the advantages of a slot construction for convenient and easy threading and which through the provision of one or more detents retains the thread against inadvertent displacement even during high speed operation of the machine.

It is an object of the present invention to provide an improved thread guide in a take-up lever for a sewing machine, the guide having a slot for conveniently accepting the thread and one or more detents for retaining the same during high speed operation of the machine.

Another object of this invention is the provision of a take-up lever which is simple and rugged in construction and economical to manufacture.

Other and further objects of this invention will become apparent from the following description when considered in connection with the accompanying drawings.

BRIEF DESCRIPTION OF PREFERRED EMBODIMENTS

Figure 6:
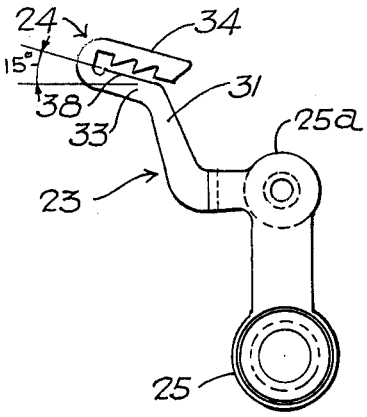
FIG. 6 is an enlarged partial elevational view of the take-up lever of the machine constructed in accordance with the present invention.

Referring to the drawings, the invention is embodied in a sewing machine 20 provided with a conventional reciprocating needle bar 21 having a needle 22. A take-up lever 23 includes a thread guide 24 which projects through a slot 25 in the housing. The take-up lever 23, (FIG. 6) includes a lower eye portion 25 which is carried on a conventional crank, not shown. An upper eye portion 25*a* is pivotally connected to a swing link 23*c* which is pivoted to the head of the machine. Except for the thread guide 24, which will be described in greater detail, the structure of the take-up lever 23 is conventional and is operable in a well known manner.

The machine includes a conventional needle thread tension mechanism 26 having a check spring 27 and a pair of fixed thread guides 28 and 29. Thread 30 from a supply spool, not shown, passes successively through guide 28, between opposed discs of tension mechanism 26, through thread guide 24, guide 29 and through the eye of needle 22.

In accordance with the present invention, the take-up lever 23 includes a lever arm portion 31, which is inclined from a vertical line. Integral with the lever arm portion 31 is a thread guide, indicated generally by the numeral 24. My invention contemplates several embodiments of thread guides, as illustrated in FIGS. 7–11, each of which will be described fully in detail.

Figure 7:
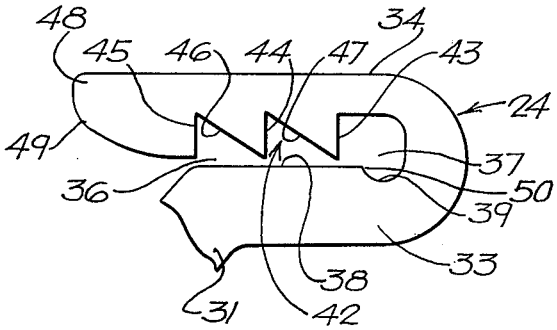
FIGS. 7 through 11 inclusive, are fragmentary elevational views of different embodiments of the thread guide, in accordance with my invention.

Considering first the preferred embodiment illustrated in FIG. 7, the thread guide 24 includes a first arm portion 33 and an integral reversely directed second arm portion 34 overlying the first arm portion 33 in spaced relation and providing an open ended slot 36 terminating in an aperture 37. The edge 38 of the arm portion 33 constituting the bottom of the slot 36 is straight and is inclined upwardly approximately 15° in respect to a horizontal line. Said edge 38 intersects with an arcuate portion 39 constituting the bottom of the aperture 37. In this embodiment the center of the arcuate portion 39 is disposed above the straight edge 38 thereby providing a relatively shallow recess. The second arm portion 34 includes a depending detent formation 42 disposed in confronting relation to the straight edge 38. In this embodiment, as illustrated in FIG. 7, there are three spaced parallel vertical edges 43, 44 and 45 connected by two angular edges 46 and 47 in the relationship shown. Each of the vertical edges 43–45 is disposed substantially at a right angle to the straight edge 38 and terminates just short of the straight edge 38 providing a longitudinal slot 36 for the passage of thread into the aperture 37. As viewed in FIG. 7, the first vertical edge 43 is offset to the left of the point 50 constituting the intersection of the straight edge 38 with the arcuate portion 39. The free end 48 of arm portion 34 overhangs arm portion 33 and terminates in a bevelled or rounded edge 49 leading into slot 36.

During the operation of the machine, the thread guide 24 in a single cycle passes through each of the positions of the take-up lever illustrated in FIGS. 1 through 5 and regardless of the condition of the thread 30, whether tight or slack, the thread is prevented from moving out of the slot 38 by any one of the edges 43–45, each of which functions as a detent for the thread.

For illustrative purposes and for greater clarity in understanding of the problem solved by the present invention, FIGS. 12 through 16 illustrate, on an enlarged scale, different angular dispositions of the slot S in a thread guide G of a take-up lever, in a single cycle of operation. Said positions correspond respectively, to the positions of the thread guide 24 shown in FIGS. 1–5. It will understood that the thread guide G shown in FIGS. 12–16 is merely exemplary of a thread guide having a slot without any means for preventing threading-out of a thread.

Figure 17:
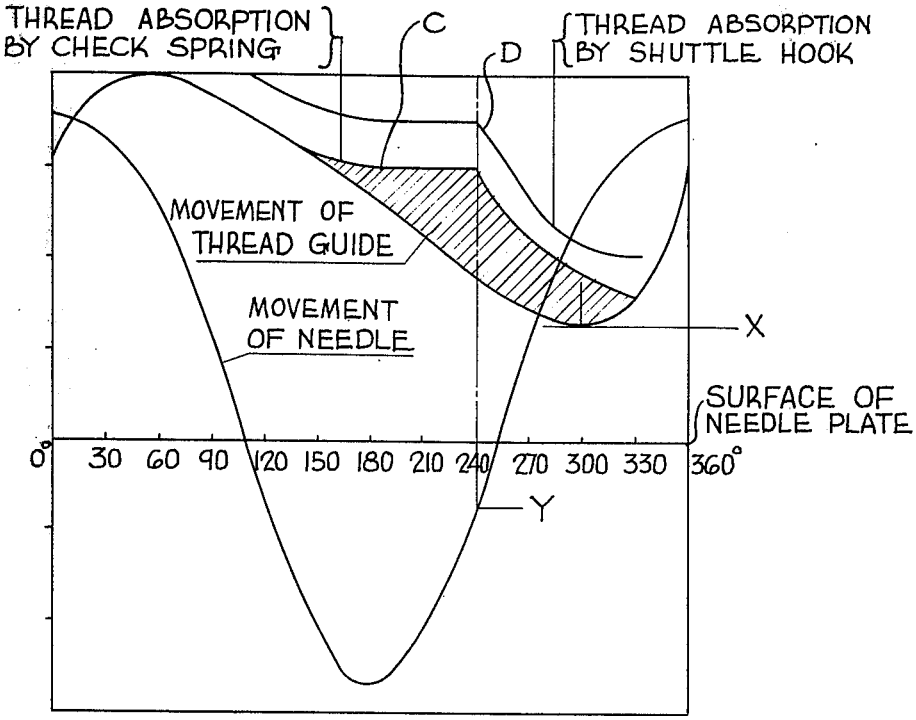
FIG. 17 is a graphic motion diagram illustrating the relationship between the needle bar, thread guide and the thread absorption by the check spring and shuttle hook of the machine in a cycle of operation.
Figure 12:
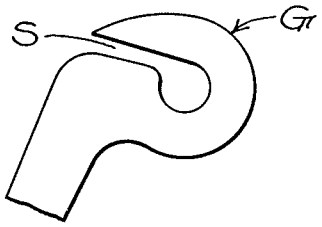
FIGS. 12 through 16 are fragmentary elevational views of a typical conventional prior art thread guide illustrating the different positions assumed by the lever in a cycle of operation.
Figure 13:
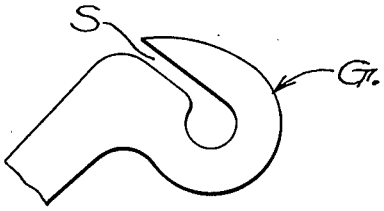
Figure 14:
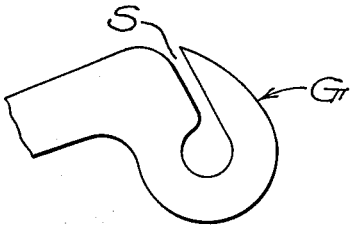
Figure 16:
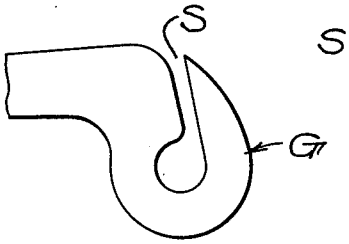
Figure 15:
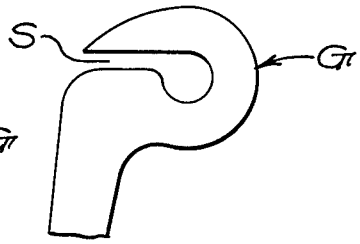

FIG. 17 is a graphical motion diagram showing the movement of the needle 22 in relation to the thread guide 24 during one complete revolution of the main shaft of the sewing machine.

Figure 1:
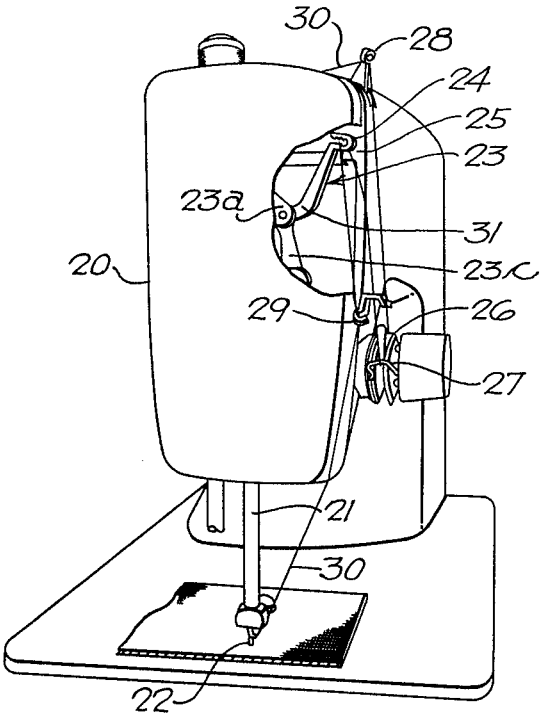
FIGS. 1–5 are end perspective views of a sewing machine, in accordance with my invention, with a part broken away to show the different positions occupied by the thread guide of the take-up lever in a cycle of operation of the machine.

At the 180° ordinate, corresponding to the positions of the parts shown in FIG. 1, the needle 22 is in its lowermost position with the thread guide 24 descending. In this relationship the portion of thread 30 extending between the tension mechanism 26 and the needle 22 is just beginning to slacken.

Figure 2:
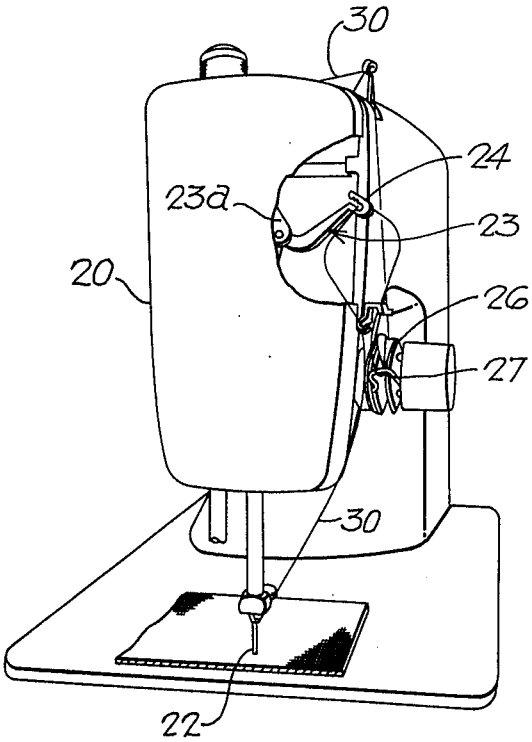

At the 210° ordinate, corresponding to FIG. 2, the needle 21 is ascending and the thread guide 24 descending, with the slack of the thread portion between the tension mechanism 26 and the needle 22 increasing.

Figure 3:
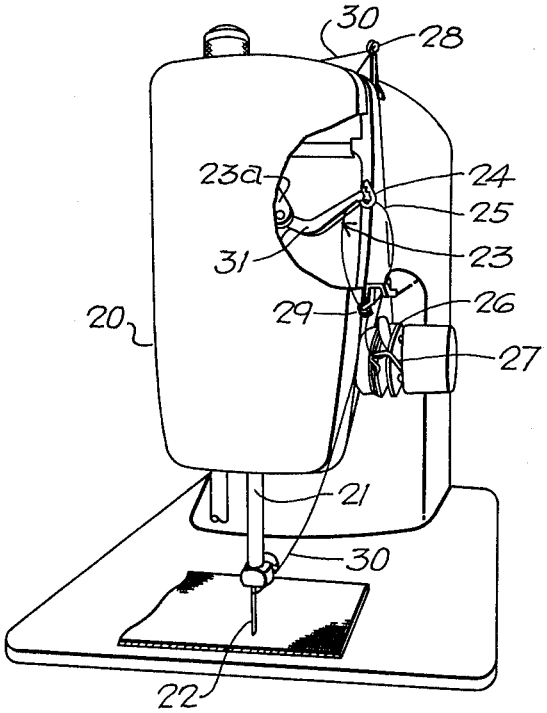

At the 240° ordinate, corresponding to FIG. 3, the needle 22 is ascending and the thread guide 24 is descending. With the slack of the thread 30 at a maximum, a loop which is in the process of formation below the needle plate will be engaged by the shuttle hook at point Y.

Figure 4:
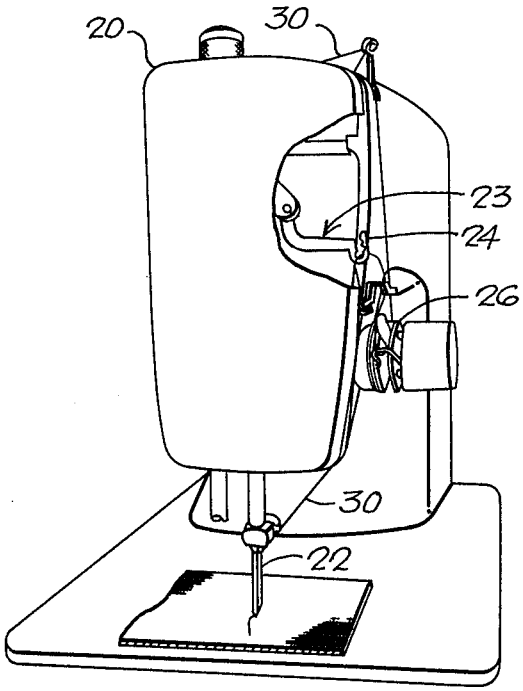

At the 300° ordinate, corresponding to FIG. 4, the thread guide 24 is at its lowermost position while the needle 22 is ascending and out of the fabric being stitched. At this point a stitch is in formation and, as will be noted, the thread guide 24 begins to ascend while the needle 22 continues to ascend.

At the 360° ordinate, the needle 22 has reached its uppermost position while the thread guide 24 continues to ascend drawing the thread tight to complete the stitch.

Figure 5:
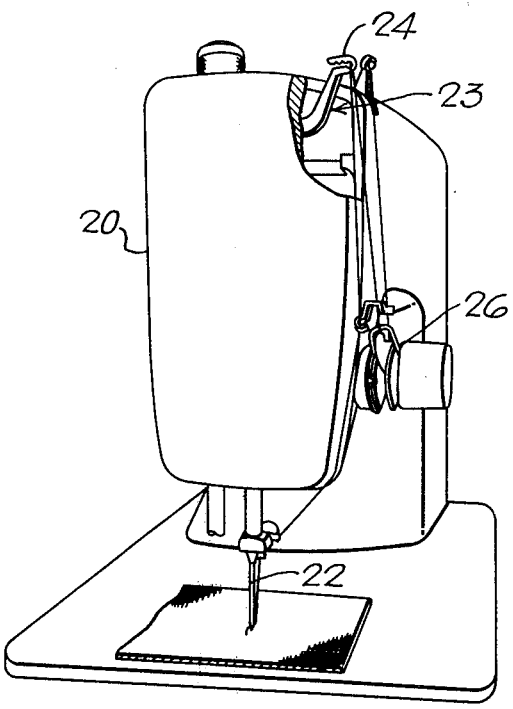

At the 60° ordinate, corresponding to FIG. 5, the thread guide 24 is in its uppermost position while the needle 22 is descending. The thread 30 now is tightly drawn and the stitch is complete.

Referring to FIG. 17 the curves C and D illustrate the thread absorption by the check spring and the shuttle hook respectively. It will be noted that between 180° and 240° ordinates, just prior to the engagement of the shuttle hook with the thread loop, the thread absorption remains static. The shaded portion of the graph between the 150° and 330° ordinates represents the interval in the timing of the thread guide 24 wherein the thread carried by the thread guide is in a slackened condition, this condition peaks at the 240° ordinate and then diminishes as the shuttle hook engages the thread for stitch formation.

In each of the modified embodiments of the thread guides 24*a*, *b*, *c* and *d*, illustrated in FIGS. 8–11, the first arm portions 33*a*, *b*, *c* and *d*, respectively, are identical with arm portion 33 and with each other. Each thread guide includes a second arm portion 34 overlying a respective first arm portion in spaced relation and providing an open ended slot 38 terminating in an aperture 37. Identical numerals with different alphabet subscripts are utilized to identify corresponding parts in the modified embodiments.

Figure 8:
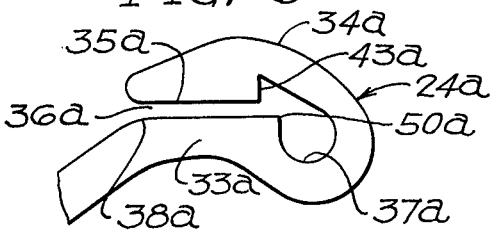

Referring to FIG. 8, the second arm portion 34*a* includes a depending vertical edge 43*a* normal to the straight edge 38*a* and constituting a detent. The vertical edge 43*a* is offset to the left of the point 50*a* constituting the intersection of the straight edge 38*a* with the aperture 37*a*.

Figure 9:
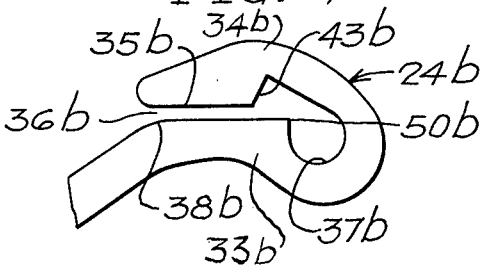

The modified embodiment illustrated in FIG. 9 is similar to that illustrated in FIG. 8, except that the edge 43*b* is angularly inclined in a downwardly direction away from a vertical line.

Figure 10:
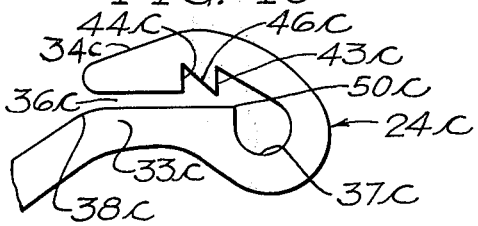

In the embodiment illustrated in FIG. 10, two spaced depending parallel vertical edges 43*c* and 44*c* normal to edge 38*c* are provided and are connected by an angular edge 46*c* in the relationship shown, thus, constituting two detents.

Figure 11:
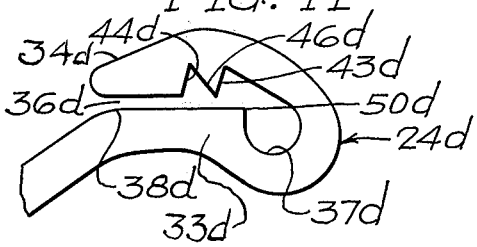

In the embodiment illustrated in FIG. 11 the depending straight edges 43*d* and 44*d* are inclined downwardly from a vertical line and are connected by an angular edge 46*d* and also constitute two detents.

In each of the modified embodiments shown in FIGS. 8–11, each of the vertical edges 43*a*, *b*, *c*, *d* is offset to the left of the respective apertures 37*a*, *b*, *c*, *d* and terminates short of the straight edges 38*a*, *b*, *c*, *d* thereby affording a slot for the passage of thread into a respective aperture. The centers of each arcuate portion of each of the apertures are disposed below the edges 38*a*, *b*, *c*, *d*. Thus, each such aperture has a greater depth than the corresponding aperture 37 of the embodiment illustrated in FIG. 7.

In the operation of the machine, each of the thread guides 24 of each of the embodiments passes through each of the positions illustrated in FIGS. 1–5 and FIGS. 12–16. When the upper thread 30 is under tension, corresponding to the conditions illustrated in FIGS. 1, 4 and 5, the thread will be confined in the aperture 37 of the thread guide. However, in conventional sewing machines utilizing a thread guide with an open slot, when the upper thread is slackened and in the condition illustrated in FIGS. 2, 3, 13 and 14, there is a likelihood that the thread may slip out of the slot 36. In such condition the thread 30 may be displaced from the aperture 37 and may engage either edge defining the slot 36 but more likely the upper edge.

The provision in my invention of at least one detent in the lower edge of the over-hanging second arm portion of the thread guide affords means for catching and retaining the thread to prevent inadvertent displacement of the thread from the slot. The provision of multiple detents, as in the embodiments illustrated in FIG. 7, 10 and 11, affords additional security for preventing displacement of the thread from the slot.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In a sewing machine, a take-up lever having a thread guide including a first arm portion and a reversely directed second arm portion overlying the first arm portion in spaced relation and providing an elongated slot therebetween, said slot being open at one end and communicating with an aperture spaced from said open end for accommodating the thread during the sewing operation, the edge of said first arm portion defining the lower boundary of said slot being substantially a straight line, said second arm portion including a detent constituting a depending straight edge extending in angular relation to said boundary edge with the lower end of said straight edge being disposed in confronting spaced relation to said boundary edge, said detent being spaced from said aperture in the direction of said open end and being adapted normally to prevent a thread from moving outside of said slot during the operation of said take-up lever.

2. A take-up lever for the thread of a sewing machine, comprising a member having bearing means intermediate its length for pivotally mounting said lever and including an arm extending obliquely outwardly from said bearing means, said arm having a thread guide extending obliquely upwardly from said arm and including a first arm portion and a reversely directed second arm portion overlying the first arm portion in spaced relation and providing an elongated slot therebetween, said slot being open at one end and communicating with an aperture spaced from said open end for accommodating the thread during a sewing operation, the edge of said arm portion defining the lower boundary of said slot being substantially a straight line and extending obliquely upwardly in relation to said arm, said second arm portion including a detent constituting a depending straight edge extending in angular relation to said boundary edge with the lower end of said detent being disposed in spaced confronting relation to said boundary edge, said detent being spaced from said aperture in the direction of said open end and being adapted normally to prevent a thread from moving outside of said slot during the operation of said take-up lever.

3. The invention as defined in claim 1 including at least one additional detent in linear registration with said first detent.

4. The invention as defined in claim 1 in which the edge of the detent is disposed normal to the lower boundary edge of said slot.

5. The invention as defined in claim 1 in which the edge of the detent is downwardly inclined away from the vertical line normal to said boundary edge.

6. The invention as defined in claim 1 in which the aperture includes a lower arcuate portion connected to the inner end of said boundary edge and an upper straight line portion connected to said arcuate portion and intersecting said depending straight edge to form an angle therebetween.

* * * * *